United States Patent [19]

Wood et al.

[11] Patent Number: 4,810,467

[45] Date of Patent: Mar. 7, 1989

[54] NICKEL-BASE ALLOY

[75] Inventors: John H. Wood, Ballston Spa; John S. Haydon, Mayfield, both of N.Y.

[73] Assignee: General Electric Company, Schenectady, N.Y.

[21] Appl. No.: 82,872

[22] Filed: Aug. 6, 1987

[51] Int. Cl.[4] ..... C22C 19/05

[52] U.S. Cl. ..... 420/448; 420/449; 420/447; 148/410

[58] Field of Search ..... 148/410, 428; 420/448, 420/447, 449

[56] References Cited

U.S. PATENT DOCUMENTS

| | | | |
|---|---|---|---|
| 3,390,023 | 6/1968 | Shira | 148/410 |
| 3,871,928 | 3/1975 | Smith, Jr. et al. | 148/410 |

*Primary Examiner*—Deborah Yee

*Attorney, Agent, or Firm*—Jerome C. Squillaro

[57] ABSTRACT

A high temperature-resistant nickel-base alloy adapted for use in turbine nozzle components contains carefully balanced amounts of aluminum and titanium to render the alloy repair weldable. The levels of carbon and zirconium are also carefully controlled to improve the castability of the alloy so that large turbine components may be cast without hot tearing or microshrinkage.

13 Claims, No Drawings

NICKEL-BASE ALLOY

BACKGROUND OF THE INVENTION 1. Field of the Invention

This invention generally concerns nickel-base alloys and particularly concerns a castable and weldable nickel-base alloy having sufficient creep strength for use in gas turbine multi-vane nozzle applications. 2. Description of Prior Developments Nickel-base alloy design involves adjusting the concentrations of certain critical alloying elements to achieve the desired mix of properties. For a high temperature alloy suitable for use in turbine nozzle applications, such properties include high temperature strength, corrosion resistance, castability and weldability. Unfortunately, by optimizing one property another property can often be adversely affected.

Alloy design is a compromise procedure which attempts to achieve the best overall mix of properties to satisfy the various requirements of component design. Rarely is any one property maximized. Rather, through development of a balanced chemistry and proper heat treatment, the best compromise among the desired properties is achieved.

An example of such compromise or trade-off is that between high-temperature alloys which are repair weldable or those which possess superior creep resistance. In general, the easier it is to weld a high-temperature alloy, the more difficult it is to establish satisfactory creep strength. This problem is particularly acute in the case of alloys for gas turbine applications. In addition to being repair weldable and creep resistant, gas turbine nozzle alloys should also be castable and highly resistant to low cycle fatigue, corrosion and oxidation.

Prior cobalt-based alloys have proved adequate for first stage turbine nozzle applications, notwithstanding their susceptibility to thermal fatigue cracking. The reason for the acceptance of these alloys is the ease with which they may be repair welded. However, in latter stage nozzles, cobalt-based alloys have been found to be creep limited to the point where downstream creep of the nozzles can result in unacceptable reductions of turbine diaphragm clearances. Although cobalt-based alloys with adequate creep strength for these latter stage nozzle applications are available, they do not possess the desired weldability characeristics.

While cast nickel-base alloys, as a group, possess much higher creep strengths than cobalt-base alloys, the nickel-base alloys have not generally been used in nozzle applications for heavy duty industrial gas turbines because of their well-known lack of weldability. In effect, conventional nickel-base alloys possess more creep strength than required for many turbine nozzle applications. An example of such an alloy is disclosed in U.S. Pat. No. 4,039,330. Although this nickel-base alloy possesses superior creep strength, its marginal weldability may complicate or prevent the repair of cracked turbine components by welding.

Another problem associated with using nickel-base alloys in gas turbine applications involving large investment castings is the possible detrimental effect on the physical metallurgy of the alloy which can be caused by elemental segregation. Elemental segregation occur during the relatively slow solidification of large castings at which time undesirable phases, such as eta phase, can be formed in the alloy, or can be caused to form during subsequent sustained high-temperature exposure. Since large turbine nozzle segments are subject to this condition, a carefully balanced mix of alloying elements must be maintained to avoid formation of such phases. When these phases are formed in amounts causing reductions in mechanical properties, the alloy is said to be metallurgically unstable.

Still another drawback of conventional nickel-base alloys is the often complicated and time-consuming heat treatments necessary to achieve desired end properties, which causes the cost of these alloys to be increased.

Accordingly, a need exists for a nickel-base alloy having the necessary creep strength for primary and latter stage turbine nozzle applications. This alloy, to be commercially feasible, should be castable and easy to weld in order to satisfy industry repair demands. Furthermore, such an alloy should be relatively quickly and economically heat treated and substantially immune to metallurgical instability. In addition, the alloy should possess superior resistance to corrosion and oxidation.

SUMMARY OF THE INVENTION

The present invention has been developed to satisfy the needs set forth above, and therefore has as a primary object the provision of a metallurgically stable nickel-base alloy which is both castable and weldable and which possesses a superior creep strength.

Another object of the invention is the provision of a weldable nickel-base alloy which possesses at least a 100° F. creep strength improvement over prior cobalt-base alloys.

Still another object is to provide a nickel-base alloy capable of being cast in the massive cross sections frequently required in gas turbine component applications.

Yet another object is to provide a nickel-base alloy which may be quickly and efficiently heat treated.

These and other objects are achieved with a nickel-base alloy having carefuly controlled amounts of precipitation hardening eletments and specific amounts of carbon and zirconium.

Various other objects, features and advantages of the present invention will be better appreciated from the following detailed description.

DETAILED DESCRIPTION OF THE PREFERRED EMBODIMENT

As indicated above, through development of a balanced chemistry and proper heat treatment, the best compromise among desired alloy properties may be achieved for a particular nickel-base alloy application. The primary properties which have been carefully balanced according to the present invention include creep strength, weldability and castability. More particularly, creep strength possessed by the nickel-based alloy composition disclosed in U.S. Pat. No. 4,039,330 (the reference alloy) has been traded for improved ductility and enhanced weldability without diminishing oxidation and corrosion resistance and metallurgical stability.

Starting with the reference alloy, a carefully balanced reduction is aluminum and titanium content has been found to yield a nickle-base alloy which is easily welded and which maintains all other desirable properties of the reference alloy. Moreover, to enhance foundry producibility of the reference alloy, carbon and zirconium levels have been reduced to yield an easily castable alloy. A critical aspect of the invention is to maintain the metallurgical stability and desired properties of the reference alloy by maintaining the atomic percent ratio of Al/Ti at a value about the same as that of the reference alloy while decreasing the absolute content of Al and Ti to increase ductility and weldability.

Strength in high temperature nickel alloys derives from precipitation strengthening by the precipitation of the gamma-prime [Ni3 (Al, Ti)]phase, solid solution strengthening and carbide strengthening at grain boundaries. Of these, the most potent is the gamma-prime precipitation-strengthening mechanism. In order to attain the best compromise among alloy properties for gas turbine nozzle applications, the content of the primary precipitation-strengthening elements, i.e., Ti, Al, Ta and Cb, has been reduced to decrease the unneeded or excess creep strength of the reference alloy in order to increase ductility, and thereby weldability, without adversely affecting the metallurgical stability or other desirable properties of the reference alloy. In addition, the levels of C and Zr have been carefully balanced and controlled to increase the castability of the present alloy over the reference alloy.

The determination of the composition of the present invention began with the designation of the creep strength level specifically suited for the gas turbine nozzle applications. Since high-temperature strength of Ni-base superalloys bears a direct relationship to the volume fraction of the gamma-prime second phase, which in turn bears a direct relationship to the total amount of the gamma-prime-forming elements (Al+Ti+Ta+Cb) present, it is possible to calculate the amount of these elements required to achieve a given strength level. Approximately compositions of second phases such as gamma-prime, carbides and borides, as well as the volume fraction of the gamma-prime phase, can also be calculated based on the starting chemistry of the alloy and some basic assumptions about the phases which form. By such a procedure, it was established that the alloy having the desired level of creep strength would contain about 28 volume percent of the gamma-prime phase with a total (Al+Ti+Ta+Cb) content of about 6 atomic percent.

The key elements in the formation of the gamma-prime phase are Al and Ti, with the Ta and Cb remaining after MC carbide formation playing a lesser but not insignificant role. The ratio of the atomic percent Al, to the atomic percent Ti was kept constant at 0.91, which is its value for the reference alloy, in an attempt to maintain the excellent corrosion properties and metallurgical stability exhibited by the reference alloy. To insure castability of the new alloy, both carbon and zirconium were reduced from the nominal values of the reference alloy of commercial practice. Past experience has shown that when C levels exceed about 0.12 weight percent or Zr levels exceed 0.04 to 0.05 weight percent, microshrinkage and/or hot tearing are more likely to occur during casting of large-size turbine components such as buckets or nozzles. Therefore, the C content of the alloy was set at a nominal 0.1 weight percent and the Zr content at a nominal 0.01 to 0.02 weight percent. Using these rules and assumptions the amount of these critical elements in the new alloy composition were calculated. The total composition of the resulting alloy, which provides a first approximation of the balanced Al and Ti percentages required to produce an approximate 28 volume percent gamma-prime alloy, is set forth in Table 1 below:

TABLE 1

| ELEMENT | WEIGHT % | ATOMIC % |
|---|---|---|
| Ni | 50.98 | 49.64 |
| Co | 19.0 | 18.42 |
| Cr | 22.5 | 24.72 |
| W | 2.0 | 0.62 |
| Ta | 1.05 | 0.33 |
| Cb | 0.92 | 0.57 |
| Al | 1.16 | 2.46 |
| Ti | 2.26 | 2.70 |
| Zr | 0.02 | 0.01 |
| B | 0.01 | 0.05 |
| C | 0.10 | 0.48 |

Vol. % gamma-prime = 28.41%

Additional refinements led to the values identified in Table 2 wherein the melt chemistry of the reference alloy is provided for comparison:

TABLE 2

| | WEIGHT % | | | |
|---|---|---|---|---|
| ELEMENT | AIM | PREFERRED MELT CHEMISTRY RANGE | ACCEPTABLE MELT CHEMISTRY RANGE | REFERENCE ALLOY MELT CHEMISTRY RANGE |
| Ni | Bal. | Bal. | Bal. | Bal. |
| Co | 19 | 18.5–19.5 | 10–25 | 5–25 |
| Cr | 22.5 | 22.2–22.8 | 20–28 | 21–24 |
| W | 2.0 | 1.8–2.2 | 1–3 | 1.0–5.0 |
| Al | 1.2 | 1.1–1.3 | 0.5–1.5 | 1.0–4.0 |
| Ti | 2.3 | 2.2–2.4 | 1.5–2.8 | 1.7–5.0 |
| (Al + Ti) | 3.5 | 3.2–3.8 | 2.0–3.9 | 4.0–6.5 |
| Cb | 0.8 | 0.7–0.9 | 0.5–1.5 | 0.3–2.0 |
| Ta | 1.0 | 0.9–1.1 | 0.5–1.5 | 0.5–3.0 |
| B | 0.01 | 0.005–0.015 | 0.001–0.025 | 0.001–0.05 |
| Zr | 0.01 | 0.005–0.02 | Up to 0.05 max. | 0.005–1.0 |
| C | 0.1 | 0.08–0.12 | 0.02–0.15 | 0.02–0.25 |

Table 3 shows the tensile test results obtained on both the reference alloy (the composition being that of current commercial practice) and on an alloy having a composition approximately the same as that set forth under the optimum Aim column of Table 2. Comparison of Sample Nos. 1–4 and 9–12 of the new alloy with Samples Nos. 5–8 and 13–16 of the reference alloy indicates that the objective to reduce the strength of the reference alloy to improve ductility (and weldability) has been achieved.

TABLE 3

| | | | TENSILE PROPERTIES | | | | |
|---|---|---|---|---|---|---|---|
| Alloy | Sample No. | Heat Treatment | Temp. F. | UTS, ksi | 0.2 YS, ksi | % El | % RA |
| New | 1 | A | Room | 152.6 | 96.7 | 13.3 | 15.6 |
| " | 2 | A | " | 143.4 | 97.2 | 10.5 | 13.3 |
| " | 3 | A | " | 151.7 | 96.5 | 11.5 | 14.0 |
| " | 4 | A | " | 143.6 | 96.9 | 10.2 | 14.7 |
| Reference | 5 | A | " | 170.4 | 123.5 | 7.0 | 9.3 |
| " | 6 | A | " | 168.2 | 121.3 | 7.0 | 8.3 |
| " | 7 | A | " | 163.8 | 119.8 | 6.8 | 9.5 |
| " | 8 | A | " | 170.6 | 120.5 | 7.6 | 8.5 |
| New | 9 | A | 1400 | 93.2 | 74.9 | 4.6 | 8.0 |

TABLE 3-continued

| TENSILE PROPERTIES | | | | | | | |
|---|---|---|---|---|---|---|---|
| Alloy | Sample No. | Heat Treatment | Temp. F. | UTS, ksi | 0.2 YS, ksi | % El | % RA |
| " | 10 | A | " | 87.8 | 73.3 | 4.6 | 12.3 |
| " | 11 | A | " | 91.7 | 73.2 | 2.8 | 8.7 |
| " | 12 | A | " | 93.4 | 71.2 | 4.7 | 8.8 |
| Reference | 13 | A | " | 112.5 | 101.3 | 1.9 | 5.6 |
| " | 14 | A | " | 118.4 | 99.3 | 1.7 | 1.2 |
| " | 15 | A | " | 107.1 | 100.9 | 0.6 | 4.4 |
| " | 16 | A | " | 107.1 | 96.7 | N.A. | 5.2 |
| New | 17 | *A | Room | 109.3 | 84.7 | 5.6 | 9.8 |
| " | 18 | *A | " | 97.2 | 83.6 | 4.7 | 12.7 |
| " | 19 | *B | " | 127.3 | 104.0 | 6.6 | 11.7 |
| " | 20 | *B | " | 128.9 | 103.0 | 7.7 | 10.9 |
| " | 21 | *A | 1400 | 85.7 | 61.7 | 5.8 | 12.6 |
| " | 22 | *A | " | 88.9 | 62.7 | 5.5 | 9.4 |
| " | 23 | *B | " | 106.1 | 82.8 | 7.5 | 10.9 |
| " | 24 | *B | " | 105.5 | 82.8 | 7.3 | 9.3 |

Heat Treatment code:
A - 2120F/4 hrs. + 1832F/6 hrs. + 1653F/24 hrs. + 1291F/16 hrs.
B - 2100F/4 hrs. + 1475F/8 hrs.

The * in Table 3 denotes test bars which were machined from large slab castings prior to testing. The other data were obtained on small cast-to-size test bars. The differences observed in tensile properties for the two types of test specimens given heat treatment A are typical of Ni-base superalloys of varying section size. The data obtained from the test bars machined from slabs are more representative of actual turbine hardware, i.e. nozzles and buckets, since those are also large castings with thick sections which solidify relatively slowly. Comparison of slab bar data between the two heat treatments indicates that heat treatment B results in significantly higher ultimate and yield strengths than A with no less in ductility.

Satisfactory alloys may be produced using the alloy compositions identified under the Acceptable Range in Table 2, while superior alloys particularly suitable for use in turbine nozzle applications may be formulated using the melt chemistries set forth under the Preferred Range in Table 2. An optimum chemistry is identified in Table 2 which is easily castable, readily weldable, possesses good oxidation and corrosion resistance, and is metallurgically stable. While the creep strength of this optimum alloy is less than that of other known nickel-base alloys, including the reference alloy, the creep strength is most adequate for many gas turbine nozzle applications.

The alloys identified in Table 2 may be satisfactorily heat treated using conventional heat treatments adapted for nickel-phase alloys. For example, a heat treatment cycle of 2120F. for 4 hours, followed by 1832F. for 6 hours, followed by 1652F. for 24 hours and concluding with 1292F. for 16 hours will yield adequate results. However, this particular heat treatment which is used on the reference alloy is relatively long and expensive.

A shorter and more economical heat treatment has been developed which is particularly suited to the alloys of Table 2. Not only is the heat treatment relatively simple, it yields significantly improved values of tensile strength and yield strength. Specifically, the improved heat treatment involves a 2100F. exposure for approximately 4 hours followed by and concluding with a 1475F. exposure for about 8 hours. The values in Table 3 were derived from test samples formulated according to the preferred melt chemistry range in Table 2 and accurately reflect the properties of the optimum heat chemistry of Table 2.

Table 4 shows the stress-rupture test results obtained on both the reference alloy and on an alloy having a composition approximately the same as that set forth under the optimum Aim column of Table 2. Comparison of Samples Nos. A–G of the new alloy with Samples Nos. H and I of the reference alloy clearly indicates the reduction in high temperature strength and the increase in ductility achieved with the new alloy vs. the reference alloy. Comparison of heat treatment A vs. heat treatment B on samples of the new alloy indicates the improvement in stress-rupture life obtained with the shorter B heat treatment. Some loss in rupture ductility is experienced with heat treatment B relative to heat treatment A, but ductility of the new alloy remains well above that of the reference alloy.

TABLE 4

| STRESS - RUPTURE PROPERTIES | | | | | | | |
|---|---|---|---|---|---|---|---|
| Alloy | Sample No. | Heat Treatment | Temp., F. | Stress, ksi | Life, hrs. | % El | % RA |
| New | A | A | 1650 | 25 | 36.9 | 10.3 | 22.7 |
| " | B | A | " | " | 35.4 | N.A. | N.A. |
| " | C | *A | " | " | 34.9 | 13.0 | 16.2 |
| " | D | *A | " | " | 34.1 | 15.3 | 24.3 |
| " | E | *A | " | " | 46.1 | 15.4 | 26.6 |
| " | F | *B | " | " | 55.1 | 9.5 | 29.6 |
| " | G | *B | " | " | 57.6 | 8.3 | 17.1 |
| Reference | H | A | " | " | 250.5 | 3.5 | 3.0 |
| " | I | A | " | " | 177.5 | 3.9 | 5.7 |
| New | J | *A | 1650 | 20 | 171.3 | 17.7 | 17.8 |
| " | K | *A | " | " | 161.3 | 11.3 | 21.5 |
| " | L | *B | " | " | 229.8 | 7.5 | 15.6 |
| " | M | *B | " | " | 240.0 | 9.7 | 11.3 |
| New | N | *A | 1500 | 30 | 1205.1 | 12.9 | 25.8 |

TABLE 4-continued

| Alloy | Sample No. | Heat Treatment | Temp., F. | Stress, ksi | Life, hrs. | % El | % RA |
|---|---|---|---|---|---|---|---|
| | | STRESS - RUPTURE PROPERTIES | | | | | |
| " | O | *B | " | " | 1268.9 | 6.7 | 14.8 |
| " | P | *B | " | " | 1751.3 | 6.0 | 12.0 |

Heat Treatment Code:
A - 2120F/4 hrs. + 1832F/6 hrs. + 1653F/24 hrs. + 1292F/16 hrs.
B - 2100F/4 hrs. + 1475F/8 hrs.

The * has the same meaning as for Table 3 tensile data. It makes little difference in stress-rupture properties whether the test specimens are cast-to-size or machined from large castings. This is typical of most nickel-base superalloys.

As stated above, the intent of the invention is to trade excess creep-rupture strength available in prior nickel-base alloys for improved weldability. Weldability tests conducted on alloys formulated according to the preferred and optimum melt chemistries of Table 2 indicate that this objective has been achieved. No cracks were found either in the as welded or post-weld heat treated (2100F./4 hours) conditions in numerous test samples of these alloys, whereas similar tests on the reference alloy produce cracks in both the base metal and the weld metal. Therefore, with the proper selection of weld filler material, crack-free welds can be consistently produced with this new alloy.

Obviously, numerous modifications and variations of the present invention are possible in light of the above teachings. It is therefore to be understood that within the scope of the appended claims, the invention may be practiced otherwise than as specifically described herein.

What is claimed is:

1. A castable nickel-base alloy adapted for consistent crack-free welding, consisting essentially of, by weight percent, about 0.08% to 0.12% carbon, 0.005% to 0.02% zirconium, 0.005% to 0.015% boron, 0.9% to 1.1% tantalum, 0.7% to 0.9% columbium, 2.2% to 2.4% titanium, 1.1% to 1.3% aluminum, the sum of aluminum plus titanium being about 3.2% to 3.8%, 1.8% to 2.2% tungsten, 22.2% to 22.8% chromium, 18.5% to 19.5% cobalt, with the remainder essentially nickel, wherein the weight of said carbon and the weight of said zirconium are each limited to yield an easily castable alloy free from hot tearing and microshrinkage, wherein the weight of said titanium, the weight of said aluminum, the weight of said tantalum and the weight of said columbium are limited to yield an easily weldable ductile alloy, and wherein said titanium, said aluminum, said tantalum, and said columbium comprise gamma-prime forming elements which form a gamma-prime precipitate phase for precipitation strengthening said alloy.

2. The alloy of claim 1, wherein said alloy has been heat treated at 2100F. for 4 hours and at 1475F. for 8 hours.

3. The alloy of claim 1, containing about 6 atomic percent of said gamma-prime-forming elements.

4. The alloy of claim 1, containing about 28 volume percent of said gamma-prime precipitate phase.

5. The alloy of claim 1, wherein a ratio of the atomic percent of said aluminum to the atomic percent of said titanium is about 0.91.

6. A castable nickel-base alloy adapted for consistent crack-free welding, consisting essentially of, by weight percent, about 0.1% carbon, 0.01% zirconium, 0.01% boron, 1.0% tantalum, 0.8% columbium, 2.3% titanium, 1.2% aluminum, the sum of aluminum plus titanium being about 3.5%, 2.0% tungsten, 22.5% chromium, 19% cobalt, with the remainder essentially nickel, wherein the weight of said carbon and the weight of said zirconium are each limited to yield an easily castable alloy free from hot tearing and microshrinkage, wherein the weight of said titanium, the weight of said aluminum, the weight of said tantalum and the weight of said columbium are limited to yield an easily weldable ductile alloy, and wherein said titanium, said aluminum, said tantalum, and said columbium comprise gamma-prime forming elements which forms a gamma-prime precipitate phase for precipitation strengthening said alloy.

7. The alloy of calim 6, wherein said alloy has been heat treated at 2100F. for 4 hours and at 1475F. for 8 hours.

8. The alloy of claim 6, containing about 6 atomic percent of said gamma-prime-forming elements.

9. The alloy of claim 6, containing about 28 volume percent of said gamma-prime precipitate phase.

10. The alloy of claim 6, wherein a ratio of the atomic percent of said aluminum to the atomic percent of said titanium is about 0.91.

11. The alloy of claim 7, containing about 6 atomic percent of said gamma-prime-forming elements.

12. The alloy of claim 7, containing about 28 volume percent of said gamma-prime precipitate phase.

13. The alloy of claim 7, wherein a ratio of the atomic percent of said aluminum to the atomic percent of said titanium is about 0.91.

* * * * *